United States Patent [19]

Cagle

[11] 4,203,594

[45] May 20, 1980

[54] SOCCER COURT

[76] Inventor: David G. Cagle, 4413 - 10th, Lubbock, Tex. 79416

[21] Appl. No.: 919,151

[22] Filed: Jul. 10, 1978

[51] Int. Cl.[2] ..... A63B 67/00; A63B 69/00

[52] U.S. Cl. ..... 273/411; 272/3

[58] Field of Search ..... 273/1 R, 1 E, 1 M, 1 B, 273/1 C, 1 D, 95; 272/3

[56] References Cited

U.S. PATENT DOCUMENTS

| | | | |
|---|---|---|---|
| 959,973 | 5/1910 | Tomkins | 272/3 |
| 2,311,106 | 2/1943 | Wood | 273/1 R |
| 2,823,034 | 2/1958 | Bingham, Jr. | 273/1 R X |
| 3,446,122 | 5/1969 | Raichle et al. | 272/3 |
| 3,746,340 | 7/1973 | Ellis | 272/3 X |
| 3,872,623 | 3/1975 | Spaulding, Jr. | 272/3 X |

FOREIGN PATENT DOCUMENTS

| | | | |
|---|---|---|---|
| 1031697 | 6/1958 | Fed. Rep. of Germany | 272/3 |
| 276811 | 9/1927 | United Kingdom | 273/1 R |
| 1128012 | 9/1968 | United Kingdom | 273/1 R |
| 147490 | 10/1962 | U.S.S.R. | 273/1 R |

*Primary Examiner*—Paul E. Shapiro

*Attorney, Agent, or Firm*—Wendell Coffee

[57] ABSTRACT

A soccer court having ramps, walls and plateaus is constructed such that players may practice conditioning and finesse drills. Two or four players may play a groundball match in the court.

30 Claims, 7 Drawing Figures

36
18
12
32
16
12
36
16
16
34
6
34
3
20
10
36
22
8
14
18

SOCCER COURT

CROSS REFERENCE TO RELATED APPLICATIONS

None.

BACKGROUND OF THE INVENTION (1) Field of the Invention

This invention relates to games, more specifically, it relates to games played in a court with balls.

(2) Description of the Prior Art

There is a group of groundball games in which one team moves a ball along the ground ultimately into a goal while another team attempts to defend their goal and take the ball away in order to mount their own attack. Games in this group include: soccer, in which a player uses his body (excluding his hands and arms) to propel the ball; lacrosse, in which the ball is propelled by a crosse (stick with a basket on the end); and field hockey, in which a curved stick is used to propel the ball. It is understood that when "groundball" is used in this application it refers to any or all of the above mentioned games.

While the game of soccer requires little in the way of equipment or uniforms, it does call for a large field for practice and play. The standard soccer field measures 120 yds.×75 yds. (110 m×68 m) roughly 9000 sq. yds. Though the area of a soccer field is great, only two teams may practice at the same time on the same field as there are only two goals.

There are basically two objectives of practicing soccer. First, it is important for a competitor to develop stamina in order to avoid injury and play up to his potential. Also, there is a high degree of pedal dexterity and finesse required of players.

There are modifications in the training for other sports requiring stamina which are equally applicable to soccer. Distance runners commonly run up and down hills to improve their endurance just as football players "run bleachers". However, the incorporation of inclined ramps in a game court to aid training is heretofore unknown.

It has long been known that repeatedly hitting a ball against a wall improves hand-eye coordination. This method of practice has been extensively used in tennis and is equally applicable to foot-eye and head-eye coordination demanded in soccer.

SUMMARY OF THE INVENTION (1) New and Different Function

I have invented a court, about 1/100th the area of a regulation soccerfield, on which atheletes may practice soccer or play a groundball game. The dimensions of a court, according to my invention, 35 yds.×2.7 yds. (32 m×2.4 m=95 sq. m), are such that it will fit easily beside a tennis court in a city park or school ground.

a game played according to my invention forsters one-on-one, face-to-face play without reducing the game to guessing where the next ricochet will land. The one-on-one confrontation between skilled players makes soccer exciting for players and spectators alike. The excitement of this confrontation is accented in a game between only two or four players as ultimately each confrontation is one-on-one.

It is possible to simulate virtually every type of pass and situation which could arise in a soccer game by using the walls of this court. The inclined ramps in my invention necessitates superior ball control in order to advance against a defender toward the goal. Another advantage of the ramp is that running up and down them approximates the amount of running in a real game on a regulation field.

The fact that the court is totally enclosed eliminates wasted time chasing balls. The enclosure, however, is at least partially wire mesh or chain link so that adequate light, view and ventilation are afforded.

(2) Objectives of This Invention

An object of this invention is to facilitate the practicing and playing of groundball games.

Further objects are to achieve the above with a structure that is sturdy, compact, durable, simple, safe, versatile, ecologically compatible, and energy conserving, yet inexpensive and easy to manufacture, install, adjust, and maintain.

Other objects are to achieve the above with a method that is versatile, ecologically compatible, energy conserving, rapid, efficient, and inexpensive, and does not require skilled people to install, adjust, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENTS

Figures 1, 2:
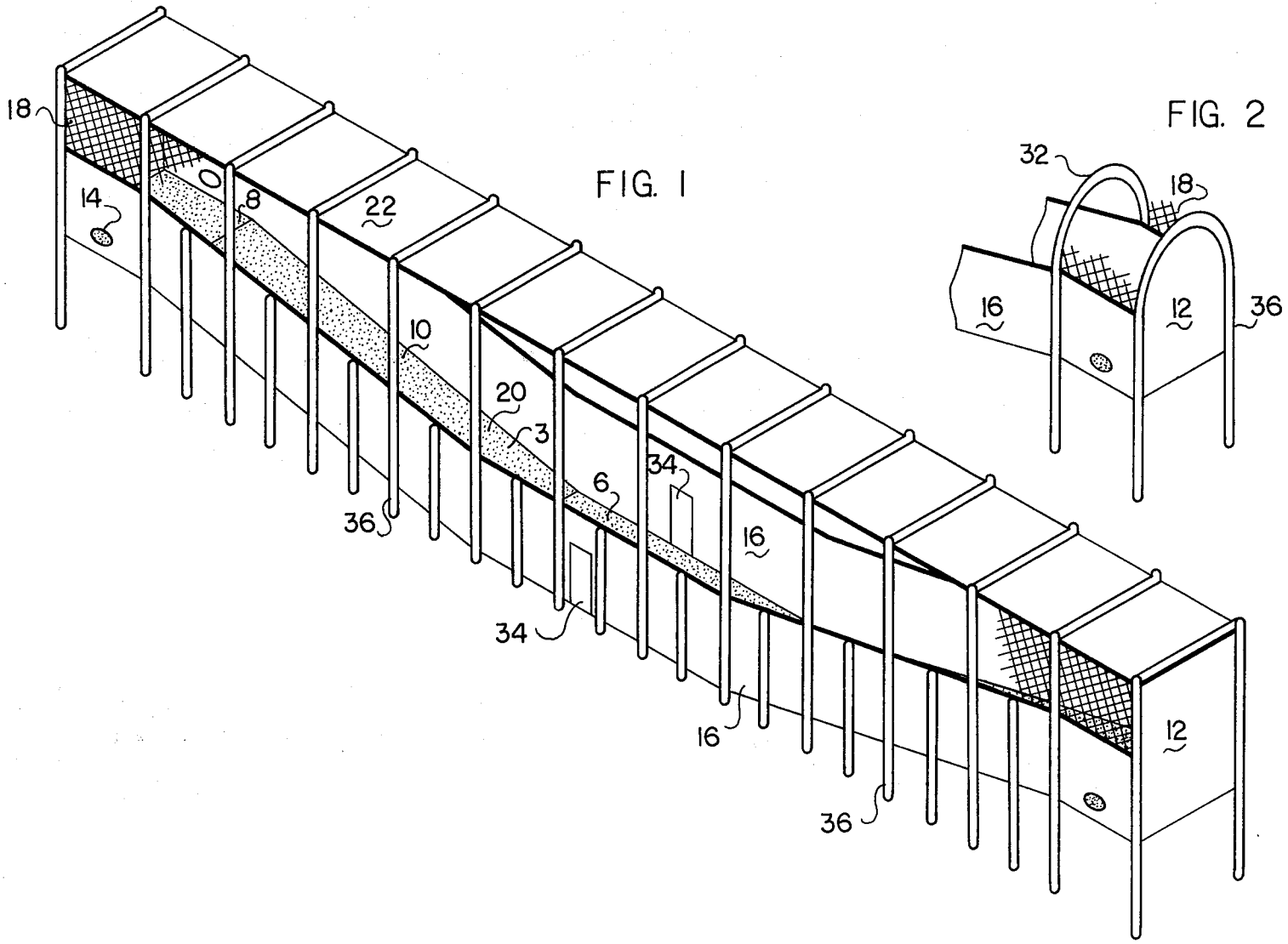
FIG. 1 is a perspective view of an embodiment of my invention.
FIG. 2 is a partial perspective view of another embodiment.

Referring to the drawings, it may be seen that the soccer court includes a playing surface having width W, length L, low kick-off plateau 6 and ramps 10 which abutt both the kick-off plateau 6 and higher goal plateaus 8. It may also be seen that planar sidewall 16 rises about eight feet (equal to the width W) above floor 3 of the playing area on both sides of playing surface floor 3. Doors 34 are located in each sidewall at the kick-off plateau allowing ingress into and egress from the court. These sidewalls also allow a player to "pass" the ball around an opponent to a teammate or to himself.

The embodiment pictured in FIG. 1 clearly shows that sidewalls 16, playing surface 3 and wire mesh 18 are supported by means of pipes 36. These pipes 36 are also used to support planar top 22 or vaulted top 32. Pipes 36 lend rigidity to the sidewalls 16 and help keep the wire mesh 18 from losing its shape when the ball is kicked into it. This wire mesh is only partially shown in the drawings for clarity, enabling one to more clearly see and understand other features of my invention.

Soccer goals 14, in the form of holes are positioned in sidewalls 16 at the goal plateau, centered about two feet above the floor 3. Sack-like goal nets, not shown, may be added over the goals 14 for convenience and would prevent balls from leaving the court when goals are scored. The goal walls may have alternative goals for groundball games other than soccer. Goals may be covered by means of goal covers when not in use. The playing surface floor is covered by artificial turf 20. This floor covering approximates actual field conditions yet is much more durable and weatherproof.

Figure 4:
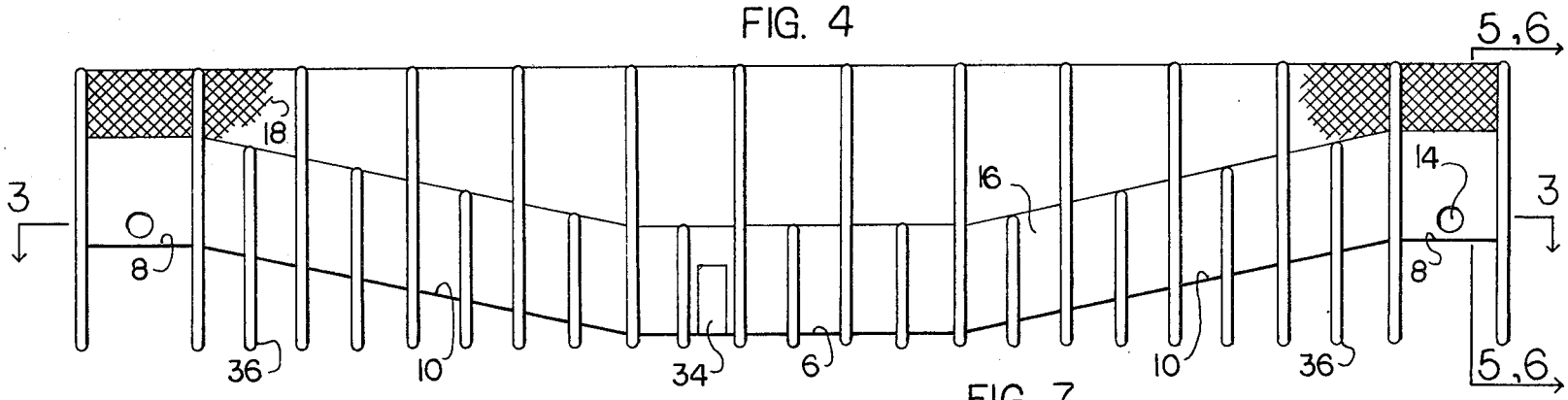
FIG. 4 is a side elevational view of the soccer court.
Figure 5:
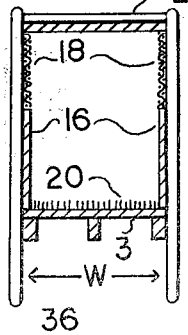
FIG. 5 is a sectional view of the first embodiment of my invention, taken substantially on line 5—5 of FIG. 4.

FIGS. 4 and 5 show the embodiment of FIG. 1 wherein the court is enclosed by planar top 22. This planar top facilitates the play of head shots and speeds up the game. The wire mesh 18 extends from the top of the sidewalls 16 to the planar top 22.

Figure 6:
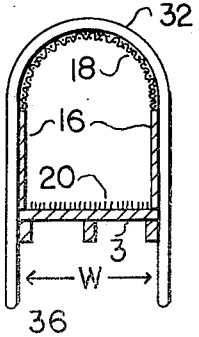
FIG. 6 is a sectional view similar to FIG. 5 showing the second embodiment of my invention.

FIGS. 2 and 6 show a second embodiment of the invention wherein the sides and top of the court, above sidewalls 16, are enclosed by wire mesh fabric 18, forming vaulted top 32. This wire mesh is only partially shown in the drawings for clarity, enabling one to more clearly see and understand other features of my invention. The wire mesh keeps the ball inside the court as well as allowing rebounds, bentilation, illumination and spectator view.

Figure 7:
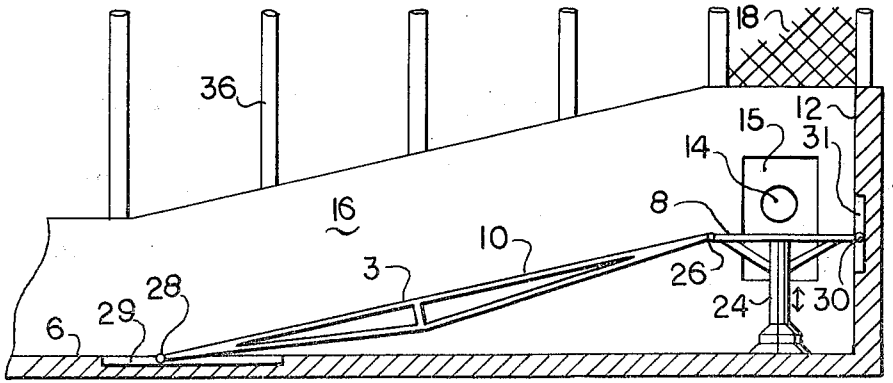
FIG. 7 is a sectional view taken substantially on line 7—7 in FIG. 3 showing yet another embodiment of my invention.

FIG. 7 shows an alternate embodiment wherein the incline of ramps 10 may be increased or decreased. Jack 24 is used to raise or lower the goal plateau 8. As the ramp is raised the degree of stamina and ball control called for is increased while if the ramp is lowered, less skilled persons may enjoy playing the game. A hinge 26 at the intersection of ramp 10 and goal plateau 8 allows the plateau to be raised or lowered but still remain level.

Roller 28, in conjunction with channel 29, keeps ramp 10 in the proper orientation with the rest of the court when the ramp is raised or lowered. This roller and channel assembly also allows the ramp to be lowered and any overlapping part of the ramp to roll flush above the kick-off plateau. Roller 30 and channel 31 provide stability at either end of the court when the incline of the ramp is altered.

It may also be seen, in FIG. 7, that soccer goals 14 may be adjustable in height by means of sliding goal board 15. The goal may thus be raised or lowered in conjunction with the raising and lowering of goal plateau 8 or they may be moved without raising or lowering the plateau to make scoring easier or harder as the match dictates.

Figure 3:
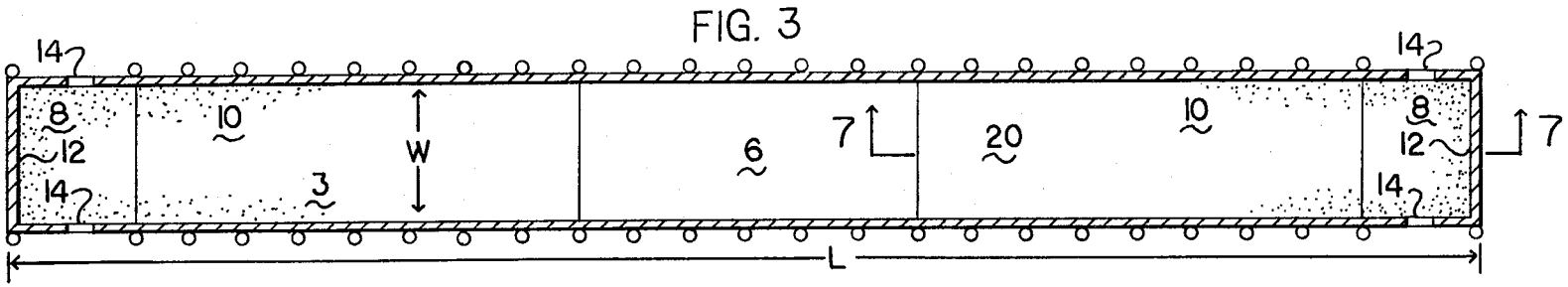
FIG. 3 is a top sectional view of my invention taken substantially on line 3—3 of FIG. 4.

FIG. 3 shows the length L of the playing surface 3 is about 12 times its width W, the length of the kick-off zone is three times the width W of the court, the length of the ramps 10 are four times the width W of the court and the length of the goal plateau 8 is equal to the width W of the court.

FIG. 4, another view of the embodiment in FIG. 3, shows that the height of the sidewalls 16 is equal to the width W of the court, and that the rise of the ramps is equal to the width of the court.

It is understood that my invention may be constructed of a number of materials including, but not restricted to, concrete, wood and metal.

As an aid to correlating the terms of the claims to the exemplary drawing, the following catalog of elements is provided:

| | |
|---|---|
| W playing surface width | L playing surface length |
| 3 playing surface floor | 22 planar top |

-continued

| | |
|---|---|
| 6 kick-off plateau | 24 jack |
| 8 goal plateaus | 26 hinge |
| 10 ramp | 28 roller |
| 12 goal wall | 29 channel |
| 14 soccer goal | 30 roller |
| 15 goal board | 31 channel |
| 16 sidewall | 32 vaulted top |
| 18 wire fabric | 34 door |
| 20 artificial turf | 36 support pipe |

The embodiments shown and described above are only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. A soccer court comprising:

a. a playing surface having
   (i) a width,
   (ii) a length of several times the width,
   (iii) a low kick-off plateau,
   (iv) two higher goal plateaus,
   (v) ramps, each of equal length and of equal incline to the other, facing the other, and running between the kick-off plateau and one of the higher plateaus, b. planar sidewalls on each side of the playing surface with at least one door therethrough, c. goal walls at the ends of the playing suface, d. goals in at least one of the walls at the goal plateau.

2. The invention as defined in claim 1 wherein the incline of the ramp is variable by means of jacks.

3. The invention as defined in claim 1 where the length is about 11 times the width of the width of the court.

4. The invention as defined in claim 1 where the length of the kick-off zone is about 2.5 times the width of the court.

5. The invention as defined in claim 1 where the length of the ramps are about three the width of the court.

6. The invention as defined in claim 1 where the length of the goal plateau is about equal to the width of the court.

7. The invention as defined in claim 1 where the sidewalls are about equal in height to the width of the court.

8. The invention as defined in claim 1 where the rise of the ramp is not greater than the width of the court.

9. The invention as defined in claim 1 where the ramps have an incline of about 1:4.

10. The invention as defined in claim 1 wherein the top of the court is a vaulted top covered with mesh wire.

11. The invention as defined in claim 1 wherein the top of the court is enclosed by a planar material.

12. The invention as defined in claim 1 wherein the goals are in the sidewalls.

13. The invention as defined in claim 1 wherein the playing surface is covered with artificial grass.

14. The invention as defined in claim 1 wherein the sides, above the sidewalls, are enclosed by mesh wire.

15. The invention as defined in claim 14 wherein the playing surface is covered with artificial grass.

16. The invention as defined in claim 15 wherein the top of the court is enclosed by a planar material.

17. The invention as defined in claim 15 wherein the top of the court is a vaulted top covered with mesh wire.

18. The invention as defined in claim 15 where the ramps have an incline of about 1:4.

19. The invention as defined in claim 18 where the rise of the ramp is not greater than the width of the court.

20. The invention as defined in claim 19 where the sidewalls are about equal in height to the width of the court.

21. The invention as defined in claim 20 where the length of the goal plateau is about equal to the width of the court.

22. The invention as defined in claim 21 where the length of the ramps is about three times the width of the court.

23. The invention as defined in claim 22 where the length of the kick-off zone is about 2.5 times the width of the court.

24. The invention as defined in claim 23 where the length is about 11 times the width of the width of the court.

25. The invention as defined in claim 24 wherein the goals are in the sidewalls.

26. The invention as defined in claim 25 wherein the incline of the ramp is variable by means of jacks.

27. The method of playing a groundball game wherein each team:

a. moves a ball from a low kick-off plateau,
b. moves the ball up a ramp to a higher goal plateau, and
c. moves the ball through a goal at the goal plateau while
d. preventing the other team from taking the ball, at any time and at any area of play.

28. The invention as defined in claim 27 further comprising steps of:

e. playing the ball off sidewalls while in all areas of play.

29. The invention as defined in claim 27 further comprising:

e. playing the ball from a overhead while in all areas of play.

30. The invention as defined in claim 29 further comprising steps of:

f. playing the ball off sidewalls while in all areas of play.

* * * * *